United States Patent [19]

Markwardt et al.

[11] Patent Number: 4,496,206

[45] Date of Patent: Jan. 29, 1985

[54] SIDE ENTRY ELECTRICAL WIRE CONNECTOR

[75] Inventors: Terrance L. Markwardt, Maplewood; Gerald W. Teiken, North Branch, both of Minn.

[73] Assignee: Minnesota Mining and Manufacturing Company, St. Paul, Minn.

[21] Appl. No.: 381,341

[22] Filed: May 24, 1982

[51] Int. Cl.[3] ..... H01R 11/20

[52] U.S. Cl. ..... 339/98; 339/97 R; 339/99 R

[58] Field of Search ..... 339/98, 99 R, 99 D, 339/97 R, 96, 95, 103 B

[56] References Cited

U.S. PATENT DOCUMENTS

| | | | |
|---|---|---|---|
| 3,658,088 | 4/1972 | Seim | 339/98 |
| 3,804,971 | 4/1974 | Bazille, Jr. | 339/98 X |
| 3,858,157 | 12/1974 | Bazille, Jr. | 339/98 |
| 4,191,442 | 3/1980 | Caveney et al. | 339/99 R |

FOREIGN PATENT DOCUMENTS

| | | | |
|---|---|---|---|
| 2454195 | 12/1980 | France | 339/97 R |
| 2091955 | 8/1982 | United Kingdom | 339/98 |

*Primary Examiner*—William R. Briggs

*Attorney, Agent, or Firm*—Donald M. Sell; James A. Smith; Terryl K. Qualey

[57] ABSTRACT

An electrical wire connector having a hollow, open-topped insulating body, an insulating cover formed to telescope with the body, the body and cover having complementary latches to retain them in an open position for insertion of wires into wire receiving channels in the cover and also to retain them in the closed position fully telescoped together. A slotted, flat plate wire connector element is retained in the body for connecting two wires supported in the channels in the cover upon telescoping of the cover and body together. At least one of the wire receiving channels is open-sided for insertion of a wire transversely into the channel when the body and cover are in their open position, and at least one deformable resilient finger is provided at the outer edge of each open-sided channel. The smallest wire size to be connected will snap past the resilient finger and the largest wire size to be connected will readily press down the resilient finger upon insertion so that the full range of wire sizes will be retained in the channel until the body and cover are telescoped together.

3 Claims, 6 Drawing Figures

SIDE ENTRY ELECTRICAL WIRE CONNECTOR

FIELD OF THE INVENTION

The present invention relates to a side entry electrical wire connector.

BACKGROUND OF THE INVENTION

Side entry electrical wire connectors utilizing slotted flat plate contact elements for connection to the wires have long been used to connect a tap wire to a continuous run wire as disclosed in U.S. Pat. Nos. 3,388,370; 3,804,971; 3,845,236 and 3,858,157. It has also been found desirable to use side entry wire channels where, as in the connector described herein, the wire ends are extended through the connector and severed within the connector as the connection is made. It has been recognized that in using side entry wire channels when the channels are large enough for the largest size of wire in the wire range chosen the smaller wire sizes may simply fall out of the wire channel before the connection is made. Thus, in the connectors of U.S. Pat. Nos. 3,388,370 and 3,845,236 the portion having the side entry channel is hinged to permit it to be spread apart for receipt of the larger wire sizes and in U.S. Pat. No. 3,804,971 a cover and body are telescoped together to a precrimped position after insertion of the wires to retain the wires in the proper positions.

SUMMARY OF THE INVENTION

The present invention provides an electrical wire connector having an insulating body, an insulating cover and a wire connector element. The insulating body is hollow and open-topped with a base wall and a pair of generally parallel side walls extending generally perpendicularly from the base wall. The wire connector element is a flat plate formed with a plurality of wire connecting slots and is retained in the body perpendicular to the side walls and the base wall. The insulating cover is formed to telescope with the body and it has wire receiving channels for supporting wires, one in each channel, to carry a wire into each of the connector element slots upon telescoping of the cover and the body fully together. At least one of the wire receiving channels is open-sided for insertion of a wire transversely into the channel when the body and the cover are in their open position. At least one deformable resilient finger is positioned at the outer edge of each open-sided channel. The resilient finger is constructed and positioned so that the smallest wire size to be connected will snap past it upon insertion into the channel and the largest wire size to be connected will readily press it down upon insertion to retain the full range of wire sizes in the channel until the body and cover are telescoped together. The body and cover are formed with complementary latch members to retain the body and cover in an open position to permit one wire for each wire connecting slot in the wire connector element to be inserted into each of the wire receiving channels and to retain the body and cover in a crimped position with the cover and body fully telescoped together.

THE DRAWING

DESCRIPTION OF THE PREFERRED EMBODIMENT

Figure 1:
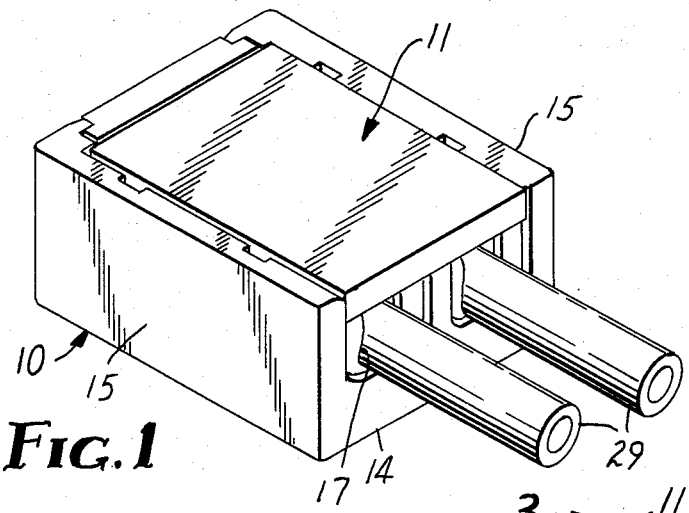
FIG. 1 is a isometric view of an electrical wire connector constructed in accordance with the present invention in the fully closed position with two wires connected therein.

The electrical wire connector of the present invention comprises an insulating body 10, an insulating cover 11 and a conductive wire connector element 12.

The body 10 is hollow and open-topped with a base wall 14 and a pair of generally parallel side walls 15 extending generally perpendicularly from the base wall. A door 16 is hinged on one end of the body 10 and it may be closed after the cover 11 is telescoped into the body 10 to seal off the end of the connector. At the opposite end the body is formed with a pair of wire entry slots 17 to assist in defining of the wire path through the connector.

The wire connector element 12 is a flat plate of a copper alloy formed with a plurality of wire connecting slots. The wire connector element is retained in the body generally perpendicular to the base wall 14 and side walls 15 centrally of the length thereof to receive wires in its connecting slots when the cover 11 is telescoped into the body 10. A U-shaped wire cut-off and strain relief element 21 has its base wall passing between the connector element 12 and the base wall 14 to position strain relief legs 22 on the wire entrance side of the connector element and a wire cut-off wall 23 on the wire exit side of the connector element 12. The wire connector element 12 is preferably formed of three quarter hard 260 cartridge brass and the wire cut-off strain relief element 21 is preferably formed of half hard 301 stainless steel.

Figure 2:
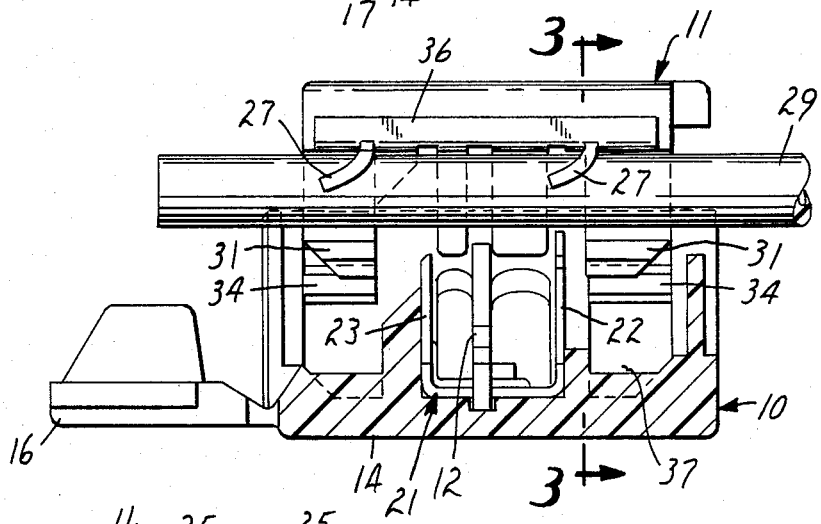
FIG. 2 is a longitudinal cross sectional view of the connector of FIG. 1 in the fully open position prior to connecting two of the largest diameter wires for which the connector is constructed.
Figure 3:
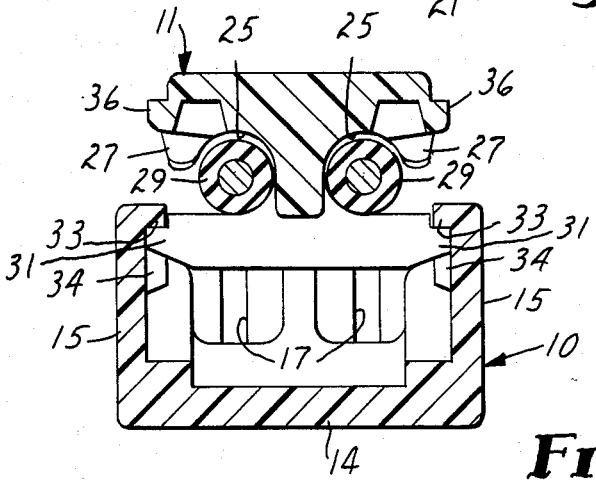
FIG. 3 is a cross sectional view taken generally along line 3—3 of FIG. 2.
Figure 4:
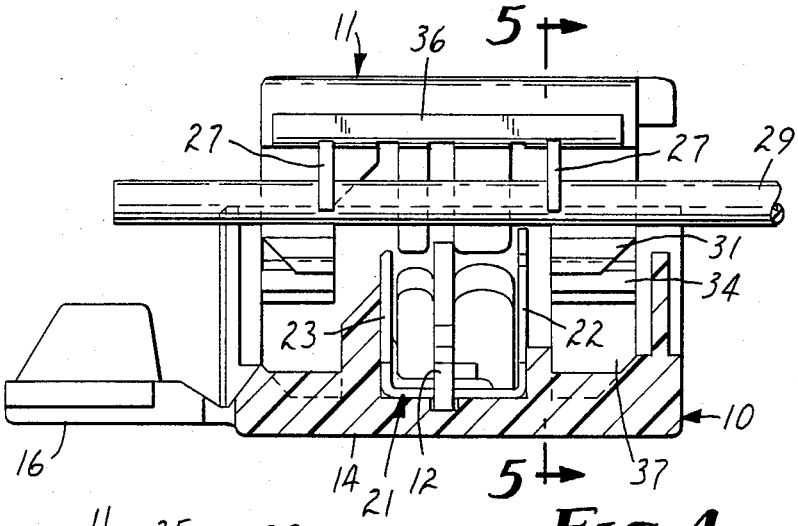
FIG. 4 is a longitudinal cross sectional view similar to that of FIG. 2 with the smallest diameter wires for which the connector is constructed inserted.
Figure 5:
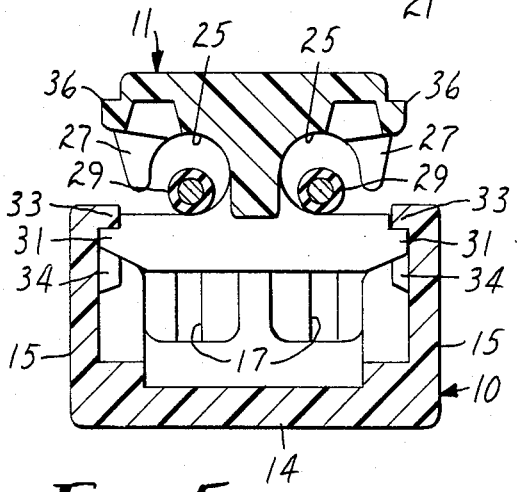
FIG. 5 is a cross sectional view taken along line 5—5 of FIG. 4.
Figure 6:
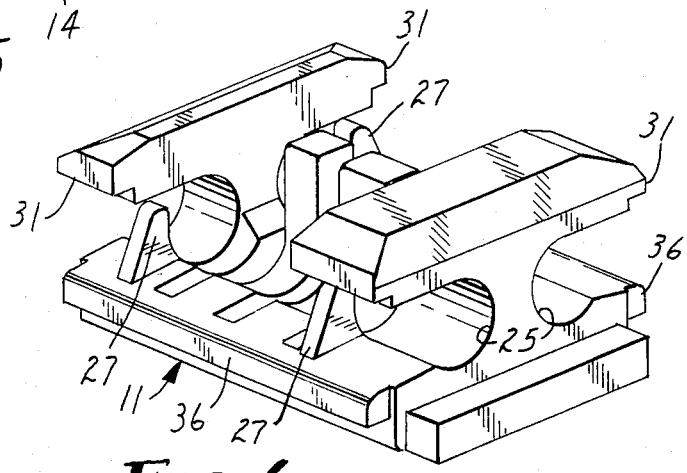
FIG. 6 is an isometric view of the cover turned upside down.

The insulating cover 11 is formed to telescope into the body 10. It has an open-sided wire receiving channel 25 along each of its sides, the surface of the cover facing the body 10 being cut away centrally (see FIG. 6) to accommodate the wire connector element 12 and the legs of the wire cut-off and strain relief element 21. A pair of deformable resilient fingers 27 are provided at the outer edge of each open-sided channel 25, one on each side of the position at which the connector element 12 makes connection to a wire in the channel when the body and cover are telescoped together. The fingers 27 are of a size and shape such that the smallest wire size to be connected will snap past them and the largest wire size to be connected will press them down upon insertion. Thus with the smallest wire size, after the wires 29 have been snapped past the fingers 27 the fingers spring back to retain them in the channels as illustrated in FIGS. 4 and 5. With the largest wire size the fingers 27 are pressed flat upon insertion of the wires 29 and they may spring back partially as illustrated in FIGS. 2 and 3. The body 10 and cover 11 of the illustrated connector are preferably molded of polypropylene with the illustrated fingers 27 having a thickness of 0.011 inch (0.028 cm.). This connector has been designed to retain and connect wires from 26 AWG through 19 AWG.

Latching projections 31 are formed at the edge of the lower surface of the cover 11 to fit between pairs of longitudinal latching ribs 33 and 34 projecting inward from the side walls 15 of the body 10. With cover projections 31 between latching ribs 33 and 34 the cover is in the open position with the wire receiving channels 25 in the cover 11 accessible for insertion of wires 29. Projections 36 are formed along the longitudinal edge of the upper portion of the cover 11 so that when the cover 11 is fully telescoped into the body 10 the upper latching projections 36 fit between the latching ribs 33 and 34 on the body 10 to retain the body and cover in the crimped position.

The connector is intended to be sold with the cover 11 and body 10 latched together in the open position and the body cavity normally filled with a waterproof grease 37. In use, an insulated wire 29 is inserted into each of the wire channels 25 in the cover 11. The cover 11 is then pressed into the body 10, usually with a parallel jaw crimping tool. The cover carries the wires 29 into the wire connecting slots in the wire connector element 12 where the insulation on the wires is cut away and connection is made to the conductors of the wires. Simultaneously the cover presses the wires 29 against the sharpened cut-off blade 23, severing the wire ends projecting out of the connector and it carries the wires down along the strain relief legs 22 and into the wire entry slots 17, the strain relief legs engaging the insulation on the wires 29 to provide strain relief.

Finally, the hinged door 16 is closed to seal the end of the connector adjacent the cut-off ends of the wires 29. The pressing of the body 10 and cover 11 together, and the closing of the door 16 extrudes the waterproof grease 37 around the connected wires 29 within the connector to fully waterproof the connection.

We claim:

1. An electrical wire connector comprising:

a hollow, open-topped, insulating body having a base wall and a pair of generally parallel side walls extending generally perpendicularly from said base wall, a flat plate, wire connector element formed with a plurality of wire connecting slots retained in said body perpendicular to said side walls and said base wall, and an insulating cover formed to telescope with said body, said cover having wire receiving channels for supporting wires, one in each channel, to carry a wire into each said connector element slot upon telescoping of said cover and said body fully together, at least one of said wire receiving channels being open-sided for insertion of a wire transversely into the channel when said body and said cover are in their open position, and at least one deformable resilient finger at the outer edge of each open-sided channel which the smallest wire size to be connected will snap past and which the largest wire size to be connected will readily press down upon insertion to retain the full range of wire sizes in the channel until the body and cover are telescoped together, said body and cover being formed with complementary latch members to retain said body and cover in said open position to permit one wire for each wire connecting slot in said wire connector element to be inserted into said wire receiving channels and to retain said body and cover in a crimped position with said cover and body fully telescoped together.

2. The electrical wire connector of claim 1 wherein said open-sided wire receiving channel has two of said resilient fingers, one on each side of the position at which said connector element makes connection to a wire in said channel when said body and cover are telescoped together.

3. The electrical wire connector of claim 1 or 2 wherein said cover has an open-sided channel along each of its sides.

* * * * *